United States Patent [19]

Waffner

[11] 4,124,156

[45] Nov. 7, 1978

[54] FEEDBACK ENHANCED WEB FEEDING APPARATUS

[75] Inventor: William D. Waffner, Grand Island, N.Y.

[73] Assignee: Moore Business Forms, Inc., Niagara Falls, N.Y.

[21] Appl. No.: 809,010

[22] Filed: Jun. 22, 1977

[51] Int. Cl.[2] ..... B65H 25/22; B65H 17/30

[52] U.S. Cl. ..... 226/25; 226/34; 226/39; 226/95; 226/97; 226/108; 226/195

[58] Field of Search ..... 226/25, 34, 35, 39, 226/38, 95, 108, 195, 97

[56] References Cited

U.S. PATENT DOCUMENTS

| | | | |
|---|---|---|---|
| 3,013,487 | 12/1961 | Faeber | 226/95 X |
| 3,774,829 | 11/1973 | Francia | 226/97 |
| 3,955,737 | 5/1976 | Traise | 226/108 |

*Primary Examiner*—Bruce H. Stoner, Jr.
*Attorney, Agent, or Firm*—Watson, Cole, Grindle & Watson

[57] ABSTRACT

In a web feed apparatus wherein a section of the web is maintained at a higher tension while accurately metering the feed of the web at a relatively lower tension, and wherein means are provided to isolate the low tension metering function from the higher tension section by anterior snubbing rolls, the web tension is controlled by modifying the gain produced by the snubbing rolls and feeding back any increase in tension from the lower web tension level to the higher web tension level. Such a gain is modified by controlling the total angle of wrap of the web about the snubbing rolls, or by varying the coefficient of friction between the web and the snubbing rolls.

4 Claims, 4 Drawing Figures

FEEDBACK ENHANCED WEB FEEDING APPARATUS

BACKGROUND OF THE INVENTION

This invention relates generally to a web feed apparatus of the type set forth in commonly owned U.S. Pat. No. 3,955,737, and more particularly to such an apparatus having a feedback function between low and high web tension.

The aforementioned commonly owned patent is specifically incorporated herein by reference. The patent discloses a nest of snubbing or capstan rolls located between a higher web tension section of web operation and a lower web tension section at web feeding and metering, for the purpose of isolating the web tensions from each other so that the desired metering accuracy at the lower web tension level at the web infeed and metering means is maintained. This isolation or force multiplication, while effective, is nevertheless limited by uncertainty as to the value of friction which can be depended upon in the capstan roll nest. Hence, the total angle of wrap of the web about the snubbing rolls must be small enough so that a tight web may be maintained at the highest possible friction value. This in turn limits the highest tension at the web operational section because the low tension side of the snubbing roll nest must be limited to a particular value. In other words, because of the uncertainty of tension ratio caused by variation in the coefficient of friction, the total wrap angle must be limited and hence the maximum tension on the high tension side of the nest must also be limited.

For example, the effect of the snubbing rolls is to isolate the high web tension from the low web tension in accordance with the basic capstan equation $T_{out}/T_{in} = e^{\mu\beta}$, wherein $T_{out}$ is the high side web tension in pounds per inch, $T_{in}$ is the low side web tension in pounds per inch, $\beta$ is the total angle of capstan wrap in radians, and $\mu$ is the apparent coefficient of friction between the web and the snubbing rolls (capstan surface). If the low side tension is limited to $0.05 \leqq T_{in} \leqq 0.15$, and the coefficient of friction is limited to $0.2 \leqq \mu \leqq 0.3$, and the high side tension is limited to $T_{out} \geqq 1.0$, for the highest friction coefficient $1/0.05 \leqq e^{0.3\beta}$, then $\beta \leqq 572°$ or 9.98 radians. Therefore, $\beta$ cannot be any larger than 9.98 radians. On the other hand, if the friction coefficient decreases to 0.2 the value of web tension at the high side will be limited as follows because of the maximum allowable value of $T_{in} = 0.15$; $T_{out}/0.15 = e^{0.2(9.98)}$, then $T_{out} = 1.1$ pounds/inch. Therefore, because of the uncertainty of the sliding coefficient of friction the tension range of $T_{out}$ is limited to 1.1 minus 1 or 0.1 pounds per inch. It is therefore desirable to increase this range and to maintain $T_{in}$ nearly constant over a wider range of output tensions ($T_{out}$).

If the capstan nest in accordance with the principles set forth in the aforementioned U.S. Pat. No. 3,955,737 is likened to an electronic or mechanical amplifier, it would be considered to be operating open loop. That is, the value of the input web tension ($T_{in}$) is not capable of being held approximately constant by modifying the overall gain of the capstan nest, in response to the value of $T_{in}$.

SUMMARY OF THE INVENTION

The present invention seeks to expand the capabilities of the capstan roll, tension multiplying system as set forth in U.S. Pat. No. 3,955,737, by enhancing the ratio of tension multiplication.

It has been found desirable to close the operating loop (referred to above) by feeding back the low web tension value and modifying the gain of the nest of snubbing rolls by modifying the wrap angle value $\beta$, the coefficient of friction value $\mu$, or both. Such is beneficial because it allows the use of a capstan nest which has a larger wrap angle $\beta$ (i.e., number of snubbing rolls) and the closed loop will adjust the tension ratio $T_{out}/T_{in}$ to compensate for friction variation.

It is therefore an object of the present invention to provide a simple and economical yet effective means for closing the operating loop of a web feed apparatus utilizing a nest of capstan rolls which effects isolation of high web tension from low web tension in accordance with the basic capstan equation $T_{out}/T_{in} = e^{\mu\beta}$, by modifying the gain of the capstan nest by modifying the $\beta$ value or the $\mu$ value.

In carrying out this basic objective, a hollow perforated roll is used as one of the snubbing rolls at the low web tension side of the capstan nest. This perforated roll is air pressurized at a constant low pressure to thereby cause the web to float off the surface of the perforated roll at low tension. Therefore, as web tension tends to increase, the wrap angle on the snubbing rolls will increase. This in turn will tend to decrease the low tension value by increasing the tension ratio.

In accordance with another embodiment of the invention, a perforated bar subjected to positive pressure is utilized as a tension sensor for the low web tension. This pressure is employed to control a vacuum transducer associated with the perforated roll of the capstan nest. Such an arrangement likewise effects a feedback of the low tension value and modifies the gain by modifying the friction value for a constant wrap angle.

DETAILED DESCRIPTION OF THE INVENTION

Figure 1:
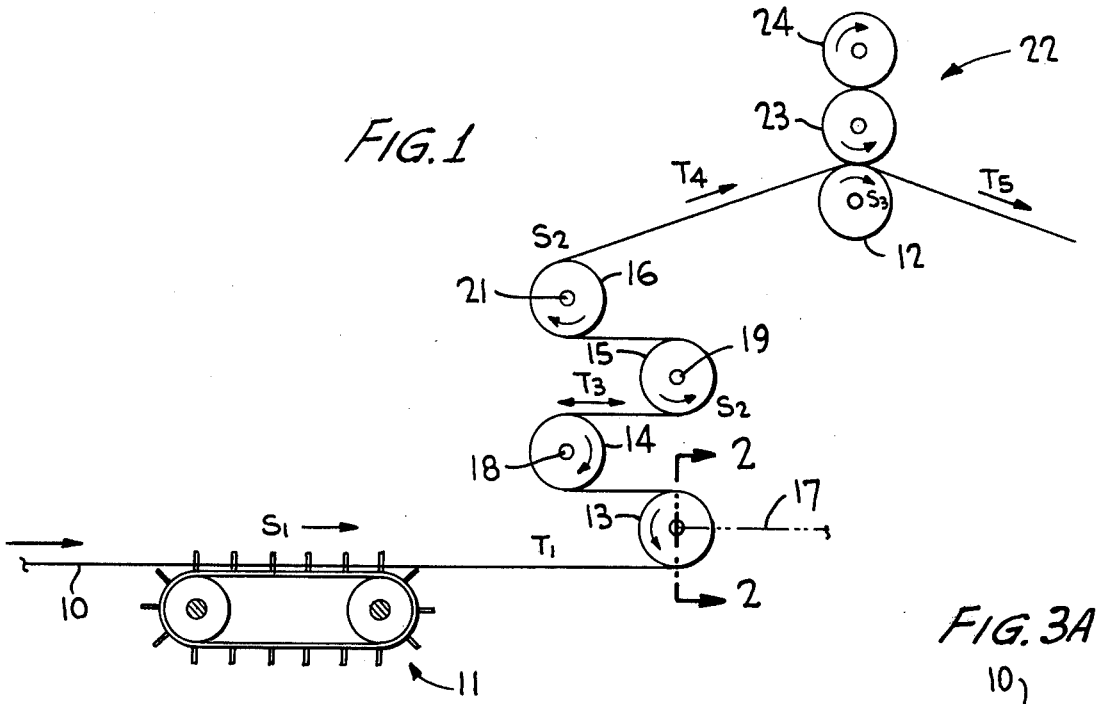
FIG. 1 is a schematic illustration of a rotary web fed press incorporating the present invention.

Turning now to the drawings wherein like reference characters refer to like and corresponding parts throughout the several views, the present invention is described, similarly as in U.S. Pat. No. 3,955,737, in relation to an offset print couple and a tractor-fed marginally punched web. Alternative operational units may, of course, be utilized in place of, or in addition to, the blanket print unit as well as alternate means of web metering and synchronization within the scope of the present invention.

FIG. 1 is similar to FIG. 1 of the aforementioned U.S. Pat. No. 3,955,737 except that the supply roll, bucket, timing belt coupling, nest of pull-up rolls and exit tractor have been omitted for the sake of clarity. Otherwise, a continuous web 10 to be printed or otherwise operated on is drawn by conventional methods and is fed by means of tractor 11 in the direction of the arrow as regularly spaced pre-punched holes along a margin or margins engage the tractor pins, of identical spacing, in the customary manner. The tractor is designated as the primary means of registration control, as determined by a conventional timing belt coupling through a pulley and belt system driven from a cooperating impression cylinder roll 12, with a ratio predetermined to provide the metering of paper via the tractor pins. In lieu of a tractor infeed, a metering drum of the fixed ratio variety may instead be used as the web infeed means.

The web is further fed over a nest of snubbing or capstan rolls 13, 14, 15 and 16, each mounted for rotation on corresponding parallel axles 17, 18, 19 and 21, and cooperatively gear driven by impression cylinder 12 and the snubbing rolls, at a ratio to be hereinafter described.

The web is further led around impression cylinder 12 of the print couple generally designated 22. This print couple is shown as including impression cylinder 12, a blanketed cylinder 23 and a plate cylinder 24. Other rolls and press components including the associated ink train mechanism are not illustrated for the sake of clarity.

In accordance with the aforedescribed arrangement, the relatively high web tension at the print couple, which is necessary and desirable in rotary press printing operations, is isolated from the low web tension permitted by the combined hole strength holding force available at the tractor feed unit. This isolation is accomplished, in the same manner as described in the aforementioned patent, by the action of the capstan-type snubbing roll system 17, 18, 19 and 21 located between tractor 11 and the infeed to the impression cylinder.

The tension T consideration and the surface paper feed S consideration are illustrated in FIG. 1. The snubbing rolls are sized to rotate at such a rate as to slightly underfeed the web from fed tractor 11. For stability and tension control, surface feed $S_3$ at the impression cylinder-to-blanket cylinder nip should not be less than surface feed $S_1$ at tractor 11, as sized for the thinnest web necessary to print. Accordingly, the web tension successively must build incrementally to $T_4$ (the same as $T_{out}$) from the infeed tension $T_1$ (the same as $T_{in}$) at the exit of the tractor pins. This is accomplished by the action of the snubbing rolls which have a surface feed $S_2$, which is less than surface feed $S_1$ or $S_3$. The snubbing rolls can be driven at any surface feed under $S_1$ or $S_3$, or can be even made stationary.

The snubbing rolls can be likewise viewed as exit control or pull-up rolls, which overfeed the web by appropriate means, so as to serve the opposite effect as the snubbing rolls on the infeed side. The web would then, of course, be traveling in a direction opposite the arrows as shown. The same slip, offset and tension release conditions apply in reverse and tension from $T_4$ back down to exit tension $T_1$ is accomplished.

Figure 2:
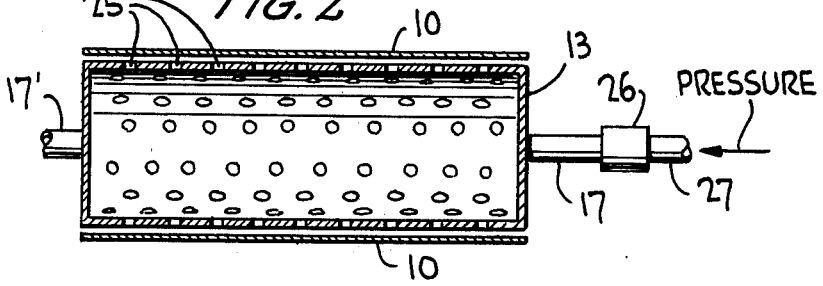
FIG. 2 is a sectional view of the perforated roll of the nest of snubbing rolls taken substantially along line 2—2 of FIG. 1.

In order to expand the capabilities of the capstan roll, tension multiplying system of the aforedescribed arrangement, at least one of the rolls such as 13 is, according to the invention, provided as a hollow perforated roll as part of the low web tension side of the capstan nest. FIG. 2 clearly illustrates such a roll as having a number of perforations 25 in its cylindrical wall, with its turning axle 17 having a rotary union 26 thereon of any conventional type for connecting a pressure line 27 to turning axle 17. The pressure line communicates with the hollow interior or roll 13 through axle 17 and union 26 in any normal manner and pressurized air from a source (not shown) is introduced into the interior of roll 13 at a low constant pressure of, for example, 1.0 psig. The effect of this pressurization is to cause web 10 to float off the surface, as shown in FIG. 2, of pressurized roll 13 at low tension. Actually, the value of pressure could be considered as determining the low web tension value which is a function of the total wrap angle $\beta$ which has now been diminished by the effect of the pressurized perforated roll.

In accordance with the aforedescribed arrangement, as web tension tends to increase, the total wrap angle $\beta$ on the rolls will likewise increase. Such, in turn, will tend to decrease the low web tension value by increasing the tension ratio $T_4/T_1$. As described earlier, this effects an intrinsic closed loop or feedback system with the input web tension as the controlled quantity. Hence, the system adjusts its capstan wrap for widely varying friction conditions and automatically selects the appropriate value of wrap angle $\beta$. By simply varying the total wrap angle value in accordance with the aforedescribed, the input web tension $T_1$ is maintained within an appropriate range desired by the tractor infeed unit. This range is determined by the holding strength and the elastic elongation error range of the tractor infeed unit on the high end of the range, and by the permissible slack in the web at $T_1$ at the low end of the range.

Figure 3A:
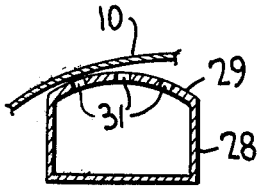
FIG. 3A is a sectional view of the pressurized bar taken substantially along line 3A—3A of FIG. 3.
Figure 3:
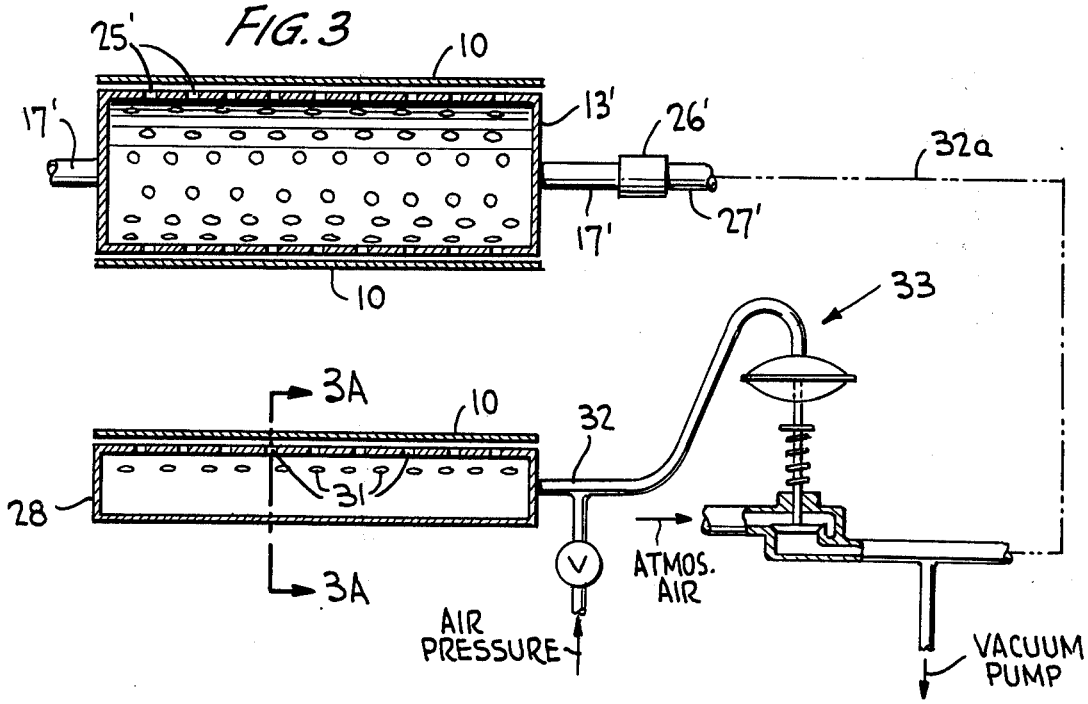
FIG. 3 is a view similar to FIG. 2 and, in addition, illustrates the pressurized bar and vacuum transducer provided for the alternative embodiment.

In accordance with another embodiment of the invention, the feedback of the low web tension $T_1$ is effected likewise with the use of a hollow perforated snubbing roll designated 13' in FIG. 3. This perforated roll is identical to the one described with reference to FIG. 2, and like parts are identified by a prime (′). By contrast, however, a perforated hollow bar 28 is provided as a tension sensor for the low web tension $T_1$. The bar has an upper crowned portion 29 as shown in FIG. 3A which is perforated as at 31. The bar is fixedly mounted in place and is disposed with its crown portion in contact with the underside of web 10 between tractor 11 and roll 13' so as to function as a tension sensor for the low web tension $T_1$. The interior of hollow bar 28 is subjected through its pressure line 32 to positive pressure from a suitable source as indicated schematically in FIG. 3. Pressure line 32 is interrupted by a pressure-to-vacuum proportional transducer 33 which is interconnected with a suitable source of vacuum pressure directed through pressure line **32*a* for subjecting the interior of roll 13' to such vacuum pressure. The transducer is of a common well known variety familiar to those having ordinary skill in the art, operating as schematically shown in FIG. 3**, so that a detailed description thereof is believed unnecessary.

Depending on the web tension at $T_1$, some or all of apertures 31 will be closed by the overlying web so as to thereby produce a reduced back pressure in line 32. Transducer 33 thereupon senses this reduced positive pressure and accordingly opens line **32*a* from the vacuum source in proportion thereto so as to permit the interior of roll 13'0 to be subjected to a corresponding increase in vacuum pressure through line 32*a*. The gain produced by the nest of snubbing rolls is therefore modified as the effective value of coefficient of friction $\mu$ is increased for a constant wrap angle by reason of the suction applied to the web through perforations 25' of roll 13'. The degree of this suction will depend upon the pressure drop through line 32 as perforations 31 of bar 28** are closed off with an increasing low web tension $T_1$.

In view of the foregoing, it can be seen that the relatively high web tension at an operating section of the web such as at 22 can be isolated from the low web tension required at the infeed by using an underfed set of tension snubbing rolls between the infeed means and the high web tension system, and that the gain offered by the snubbing rolls can be modified by modifying the $\beta$ value or the $\mu$ value so as to, in effect, feed back the low tension value of the web tension system. This feedback is automatic and maintains an acceptable range for the low web tension $T_1$ side of the capstan nest while at the same time permits a wider variance in the high web tension $T_4$ side of the capstan nest depending on the particular tension requirements of or built up at the web operation section.

Obviously, many other modifications and variations of the invention are made possible in the light of the above teachings. It is therefore to be understood that within the scope of the appended claims the invention may be practiced otherwise than as specifically described.

What is claimed is:

1. In an apparatus operative on a continuous web, including web infeed and metering means for forwardly feeding and metering said web at a predetermined displacement rate, and web operational means located posterior to said web infeed and metering means which is capable of effecting a feeding of said web, wherein differential in web tension anterior and posterior to said web operational means can exceed the holding strength and elastic elongation error range desired by said web infeed and metering means, said web infeed and metering means feeding at a first web surface feed rate and at a first web tension level ($T_{in}$), said web operational means feeding said web at a second web surface feed rate not less than said first web surface feed rate and at any common reference tension level ($T_{out}$), web snubbing rolls located between said web infeed and metering means and said web operational means for controlling said web at a third roll surface feed rate which is less than said first or said second feed rates and at any said common reference tension level, the web tension thereby increasing incrementally from said web infeed and metering means to said web operational means, said snubbing rolls effecting an isolation of said first web tension at said web infeed and metering means from the web tension present anterior to said web operational means so that desired metering accuracy at said first web tension level at said web infeed and metering means is maintained, the isolation being effected in accordance with the equation $T_{out}/T_{in} = e^{\mu\beta}$, where $\mu$ is the apparent coefficient of friction between said web and said snubbing rolls, and $\beta$ is the total wrap angle of said web about said snubbing rolls, the improvement comprising means for controlling said desired metering accuracy at said first web tension level regardless of a variation of web tension from said common reference tension level, one of said snubbing rolls adjacent said web comprising a hollow perforated roll, and said control means including means for pressurizing the interior of said perforated roll for regulating one of said total wrap angle or the value of said coefficient of friction, whereby as web tension tends to increase above said common reference tension level, said total wrap angle or the value of friction and the tension ratio $T_{out}/T_{in}$ will correspondingly increase.

2. The apparatus according to claim 1, wherein said pressurizing means comprises positive pressure means for regulating said total wrap angle by causing said web to be floated off said perforated roll.

3. The apparatus according to claim 1, wherein said control means further includes a hollow perforated bar for sensing said first web tension level and underlying said web between said web infeed and metering means and said perforated roll, said bar being subjected to positive pressure and said perforated roll being subjected to negative pressure, a common pressure line provided for said bar and said perforated roll and a pressure-to-vacuum proportional transducer being located in said line, whereby the value of friction is regulated upon suctioning the web on to said perforated roll in proportion to a decrease in pressure through said bar as perforations thereof are covered when sensing an increase in said first tension level.

4. The apparatus according to claim 1, wherein said infeed means comprises a web pin feed unit.

* * * * *